US006652294B1

(12) United States Patent
Zhang

(10) Patent No.: US 6,652,294 B1
(45) Date of Patent: Nov. 25, 2003

(54) BOARD-TO-BOARD CONNECTOR HAVING SECURELY RETAINED CONTACTS

(75) Inventor: Jian Qiang Zhang, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/202,263

(22) Filed: Jul. 23, 2002

(30) Foreign Application Priority Data

Jun. 20, 2002 (CN) ..... 091209264

(51) Int. Cl.[7] ..... H01R 12/00
(52) U.S. Cl. ..... 439/83; 439/79; 439/736
(58) Field of Search ..... 439/736, 742, 439/751, 83, 79, 80, 541.5

(56) References Cited

U.S. PATENT DOCUMENTS 3,697,933 A * 10/1972 Black et al. ..... 439/79
4,116,520 A * 9/1978 Zimmerman et al. ..... 439/79
4,597,625 A * 7/1986 Seidler ..... 439/79
4,767,342 A 8/1988 Sato
4,878,849 A * 11/1989 Talwar et al. ..... 439/79
5,037,316 A * 8/1991 Fukushima et al. ..... 439/83
5,201,661 A * 4/1993 Ii ..... 439/79
5,735,696 A * 4/1998 Niitsu ..... 439/65
5,938,456 A 8/1999 Kozel et al.
6,039,590 A * 3/2000 Kunishi ..... 439/247
6,095,827 A * 8/2000 Dutkowsky et al. ..... 439/83
6,113,440 A 9/2000 Fijten et al.
6,219,913 B1 * 4/2001 Uchiyama et al. ..... 29/883

FOREIGN PATENT DOCUMENTS

TW 456631 9/2001

* cited by examiner

*Primary Examiner*—Ross Gushi
(74) *Attorney, Agent, or Firm*—Wei Te Chung

(57) ABSTRACT

An electrical connector (1) includes an insulative housing (2) retaining a plurality of first contacts (3) and second contacts (4). The housing defines a row of upper passageways (28) for receiving the first contacts and a row of lower passageways (29) for receiving the second contacts. The housing forms a plurality of retaining poles (246, 273) thereon. The first contacts include apertures (373, 374) engaging with corresponding retaining poles. The retaining poles have free ends riveted on the first contacts for securely retaining the first contacts in the housing.

20 Claims, 8 Drawing Sheets

BOARD-TO-BOARD CONNECTOR HAVING SECURELY RETAINED CONTACTS

BACKGROUND OF THE INVENTION

1. Field of the Invention

The present invention relates to an electrical connector, and more particularly to a board-to-board connector having securely retained contacts.

2. Description of the Prior Art

A board-to-board connector includes a dielectric housing having a plurality of terminal-receiving passages, and a plurality of terminals received in the passages. Each terminal includes a contact section retained in the housing, a solder tail section projecting from the housing for soldering to a printed circuit board, and a retention section between the contact section and the solder tail section for retaining the terminal in the housing.

U.S. Pat. No. 4,767,342 discloses an electrical connector 3 for a printed circuit board (PCB) 20. The electrical connector 3 comprises an insulative housing 30 receiving a plurality of terminals 40 therein. The housing 30 defines a plurality of Z-shaped passageways therethrough. Each passageway comprises a laterally extending receiving aperture 32 defining a bottom cut 33, a lateral slot 38 and a longitudinal groove 37 between the receiving aperture 32 and the lateral slot 38. The longitudinal grooves 37 and bottom cuts 33 of the receiving apertures 32 are respectively exposed forwardly and downwardly for facilitating insertion of the terminals 40 into the housing 30. Each terminal 40 has a configuration substantially corresponding to that of the passageway, and comprises a contact head 41 for mating with a mating terminal of a mating connector, an intermediate portion 47 and a wiring portion 48. A pair of barbs 44' are formed on the contact head 41. In assembly, the contact heads 41 of the terminals 40 are inserted into corresponding receiving apertures 32 with the barbs 44' abutting against the ceiling of corresponding receiving apertures 32, the intermediate portions 47 being respectively received in the longitudinal grooves 37 via the bottom cuts 33, and the wiring portions 48 respectively extending through the lateral slots 38 for soldering to the PCB 20. However, the barbs 44' are too tiny to securely retain the terminals 40 in the housing 30. Since the longitudinal grooves 37 and the receiving apertures 32 are forwardly exposed, when the terminals 40 engage with or disengage from corresponding mating terminals of the mating connector, the intermediate portions 47 of the terminals 40 tend to forwardly escape from the longitudinal grooves 37, resulting in an undesired detachment of the terminals 40 from the housing 30.

Hence, an improved electrical connector is desired to overcome the disadvantages of the prior art.

BRIEF SUMMARY OF THE INVENTION

A main object of the present invention is to provide an electrical connector which has contacts securely retained therein.

An electrical connector in accordance with the present invention comprises an insulative housing, and a plurality of first contacts and second contacts retained in the housing. The housing defines a plurality of upper passageways arranged in an upper row for respectively receiving the first contacts, and a plurality of lower passageways arranged in a lower row for respectively receiving the second contacts. The housing forms a plurality of pairs of retaining poles thereon. Each first contact defines a pair of apertures engaging with a corresponding pair of retaining poles. Free ends of the retaining poles are riveted on the first contacts for securely retaining the first contacts in the housing. The housing has an upper wall defining a plurality of pairs of apertures. Each first contact comprises a pair of upwardly projecting barbs engaging in a corresponding pair of apertures thereby securely retaining the first contacts in the housing.

Other objects, advantages and novel features of the invention will become more apparent from the following detailed description when taken in conjunction with the accompanying drawings.

DETAILED DESCRIPTION OF THE INVENTION

Referring to FIGS. 1–4, an electrical connector 1 according to the present invention comprises an insulative housing 2, and a plurality of first contacts 3 and second contacts 4 retained in the housing 2.

Figure 5:
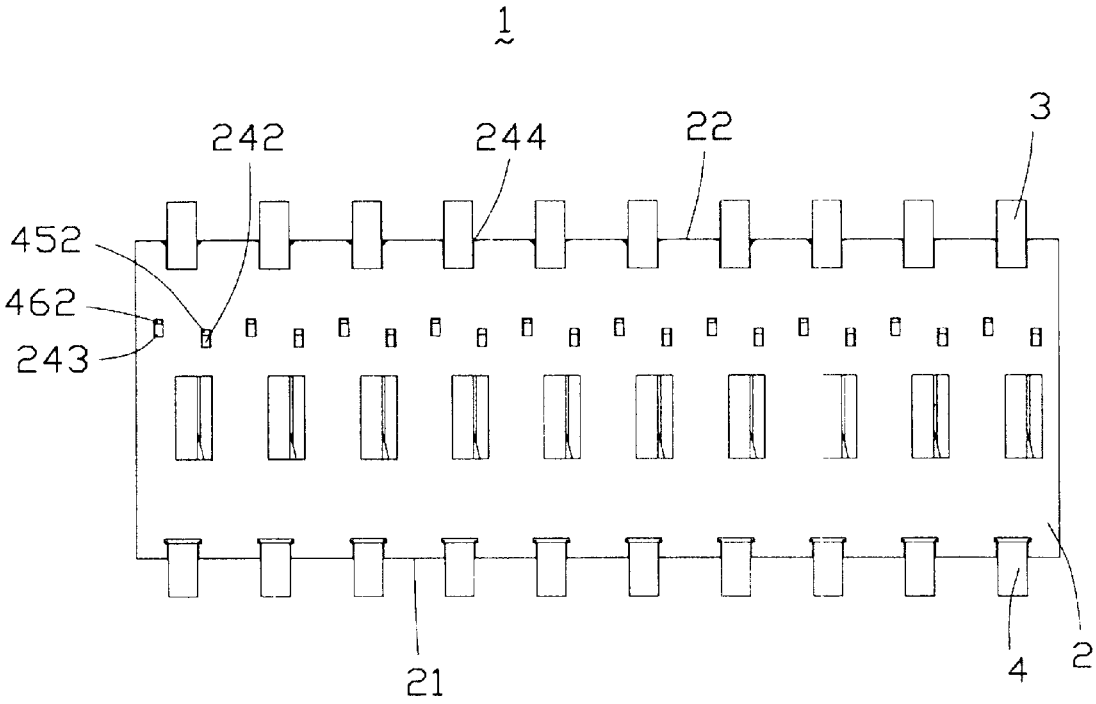
FIG. 5 is a bottom view of FIG. 4.

The insulative housing 2 is cubic and comprises opposite front and rear walls 21, 22, a top wall 23, an opposite bottom wall 24 for mounting on a printed circuit board (PCB, not shown), and opposite sidewalls 25. The housing 2 forms a plurality of upright partitioners 26 parallel to the sidewalls 25. A plurality of spacer bars 27 are formed between adjacent sidewalls 25 and partitioners 26, and parallel to and amid the top wall 23 and the bottom wall 24. The spacer bars 27, the sidewalls 25, the partitioners 26 and the top and bottom walls 23, 24 together define a plurality of upper passageways 28 and lower passageways 29. The top wall 23 defines a plurality of pairs of rectangular first and second upper apertures 232, 233 therethrough. Each pair of upper apertures 232, 233 communicate with a corresponding upper passageway 28. Similarly, referring to FIG. 5, the bottom wall 24 defines a plurality of pairs of first and second rectangular lower apertures 242, 243 therethrough. Each pair of first and second lower apertures 242, 243 communicate with a corresponding lower passageway 29.

Figure 1:
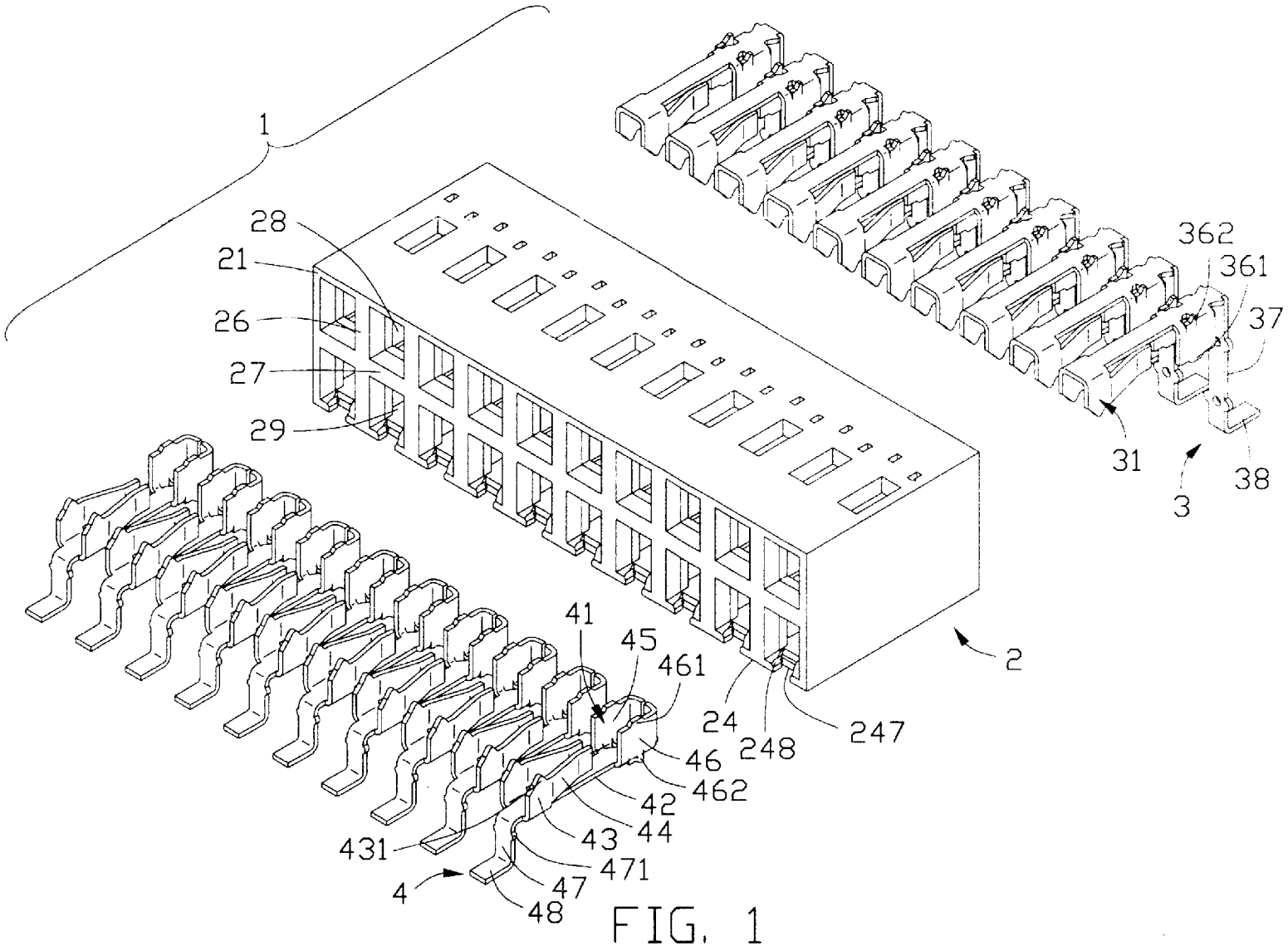
FIG. 1 is an exploded view of an electrical connector according to the present invention.
Figure 2:
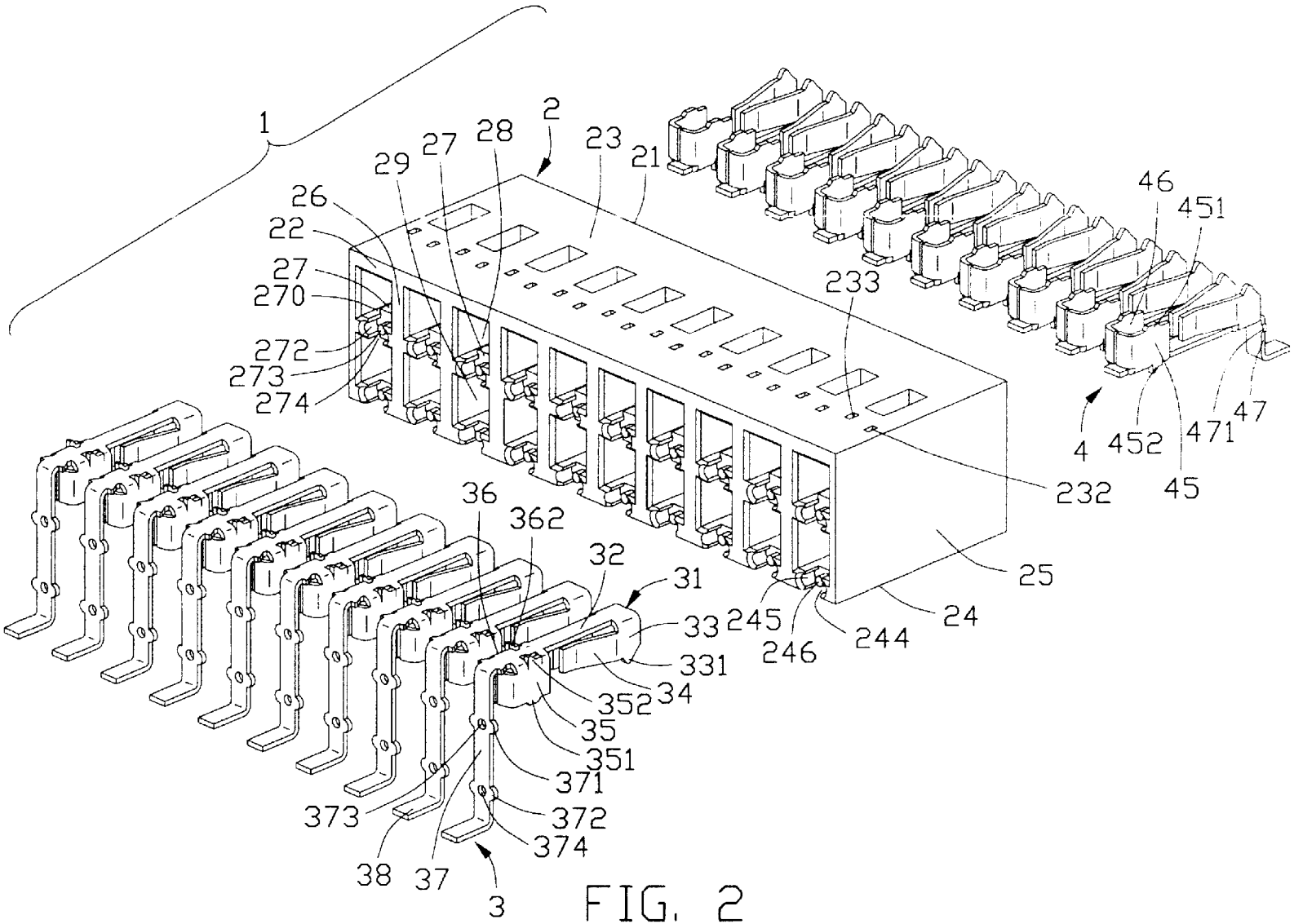
FIG. 2 is another exploded view viewed from a rear aspect.
Figure 6:
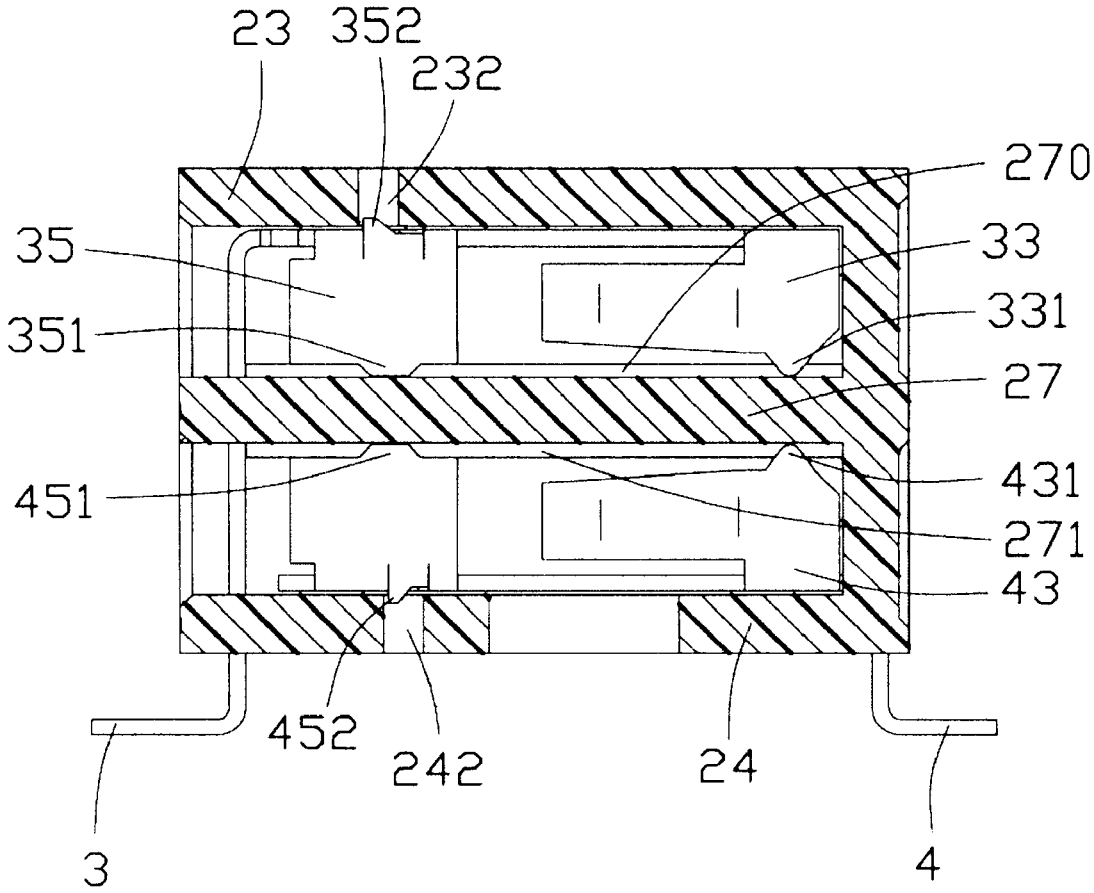
FIG. 6 is a cross-sectional view taken along line 6—6 of FIG. 4.
Figure 7:
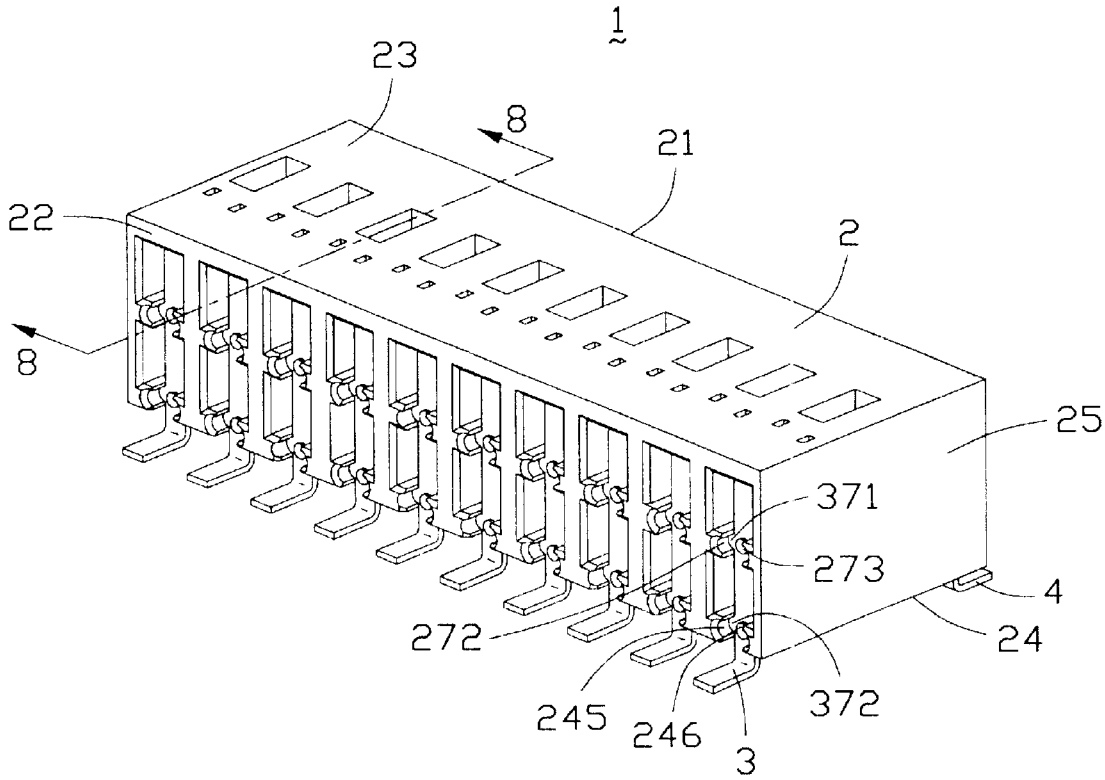
FIG. 7 is a view similar to FIG. 4, but with retaining poles of an insulative housing of the electrical connector riveted on first contacts thereof.
Figure 8:
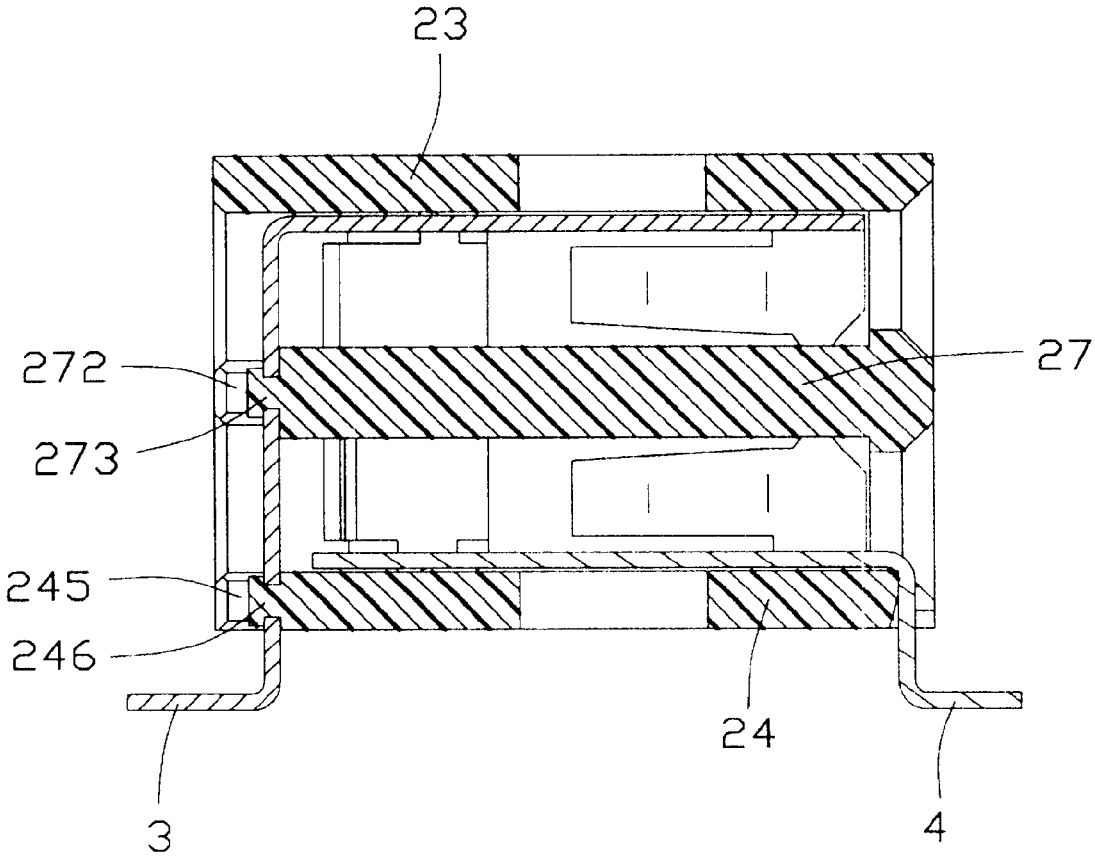
FIG. 8 is a cross-sectional view taken along line 8—8 of FIG. 7.

Particularly referring to FIGS. 1, 2 and 6, each spacer bar 27 defines a pair of opposite upper retaining grooves 270 in lateral sides of an upper face (not labeled) thereof. The grooves 270 extend in a front-to-rear direction and communicate with the upper passageways 28, respectively. Symmetrically, a pair of lower retaining grooves 271 are defined in a lower face of each spacer bar 27 and communicate with a corresponding lower passageway 29. Each spacer bar 27 defines an upper cutout 274 in a rear end thereof through the rear wall 22, and a pair of opposite semicircular upper retaining channels 272 communicating with and beside the upper cutout 274. An upper retaining pole 273 projects rearwards from the spacer bar 27 into the upper cutout 274 and is between the pair of upper retaining channels 272. Symmetrically, the bottom wall 24 comprises lower cutouts 244, lower retaining channels 245 and lower retaining poles 246 corresponding to those of the spacer bars 27. The bottom wall 24 further defines a plurality of front cutouts 247 and a plurality of pairs of front retaining channels 248 in a front end thereof through the front wall 21.

Each first contact 3 comprises a mating head 31, a solder tail 38 for soldering to the PCB, and a fixing portion 37 between the mating head 31 and the solder tail 38.

Referring to FIGS. 5–8, the mating head 31 of each first contact 3 is received in a corresponding upper passageway 28 and comprises an elongate base portion 32, a pair of opposite shoulder pieces 33, and opposite first and second retaining pieces 35, 36. The shoulder pieces 33 perpendicularly and downwardly extend from respective opposite sides of a front portion of the base portion 32 for abutting against opposite sides of the corresponding upper passageway 28. A barb 331 downwardly extends from a lower edge of each shoulder piece 33 to be retained in a corresponding upper retaining groove 270. A pair of mating arms 34 extend rearwardly from rear edges of corresponding shoulder pieces 33 and project toward each other for griping a first mating contact of a mating connector (not shown). The first retaining piece 35 and the second retaining piece 36 perpendicularly and downwardly extend from respective opposite sides of a rear potion of the base portion 32 to abut against opposite sides of the corresponding passageway 28. A pair of barbs 351, 361 respectively extend downwardly from lower edges of the retaining pieces 35, 36 to be retained in the upper retaining grooves 270. A first and a second barbs 352, 362 respectively upwardly extend from upper portions of the first and second retaining pieces 35, 36 to latch in the first and second apertures 232, 233.

The fixing portion 37 of the first contact 3 is elongate and is retained in the upper cutout 274 and the lower cutout 244. The fixing portion 37 comprises two pairs of semicircular upper and lower ears 371, 372 laterally extending from opposite sides thereof to engage in corresponding retaining channels 272, 245. A pair of upper and lower apertures 373, 374 are defined through the fixing portion 37 between corresponding pairs of ears 371, 372 for fittingly receiving corresponding retaining poles 273, 246. When the first contacts 3 are assembled to the housing 2, free ends of the retaining poles 273, 246 extending through the apertures 373, 374 are heated to be riveted on the fixing portions 37 of the first contacts 3 (shown in FIG. 8) for securely retaining the first contacts 3 in the housing 2, thereby preventing undesired relative movements of the first contacts 3 to the housing 2 and ensuring coplanarity of the solder tails 38 of the first contacts 3.

Figure 3:
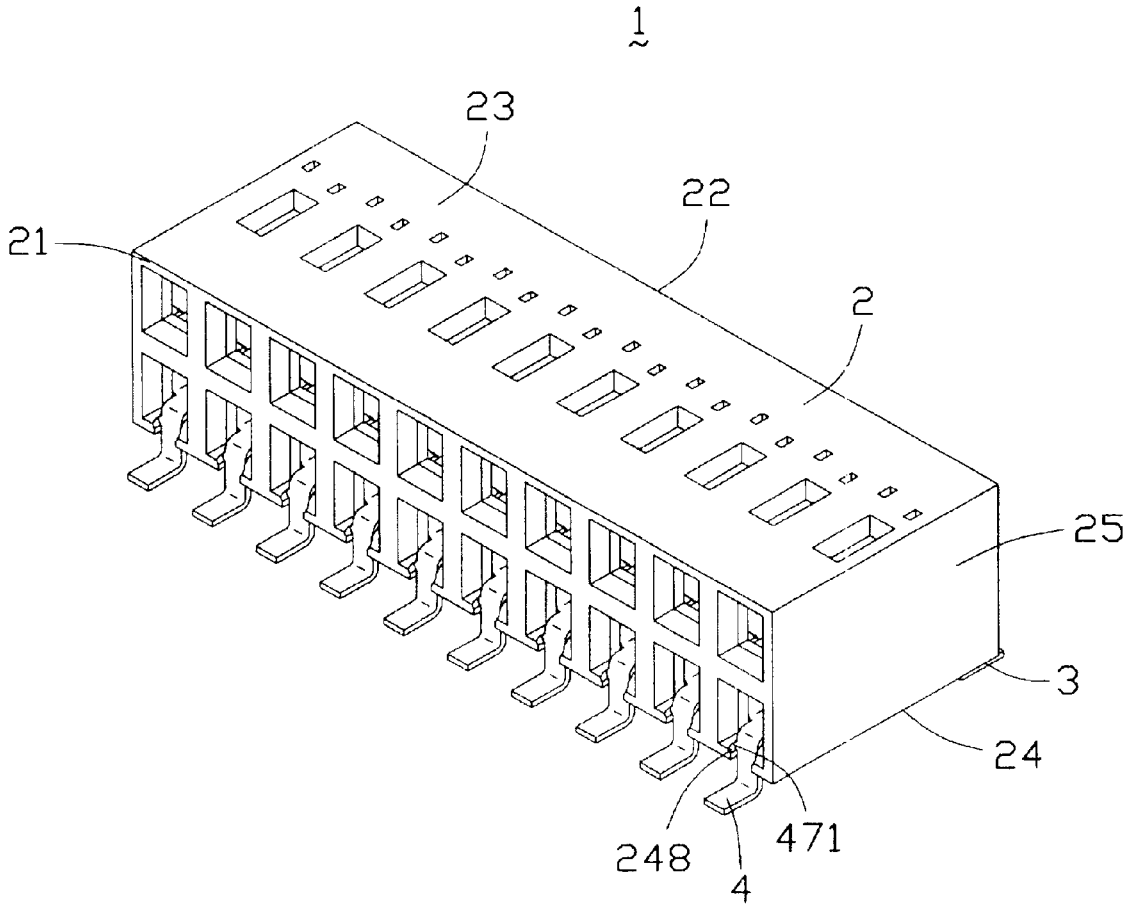
FIG. 3 is an assembled view of FIG. 1.
Figure 4:
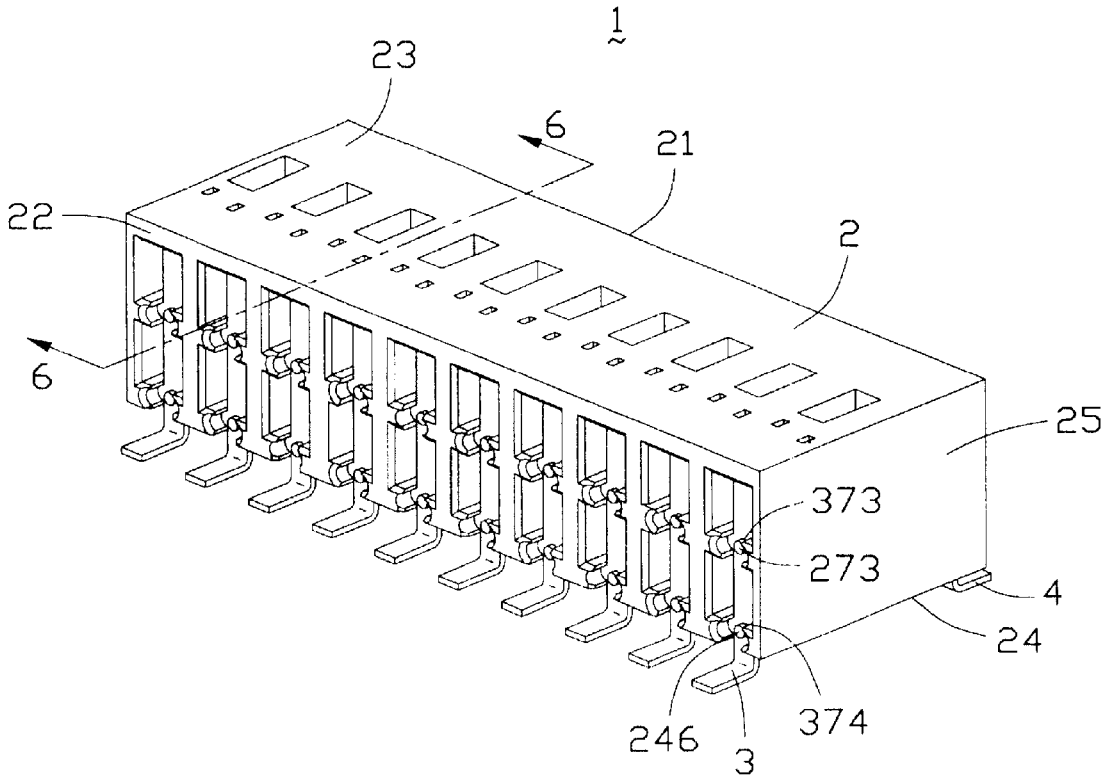
FIG. 4 is an assembled view of FIG. 2.

Particularly referring to FIGS. 1, 3 and 6, the second contacts 4 are similar to the first contacts 3 and each comprises a mating head 41, a solder tail 48 for soldering to the PCB, and a fixing portion 47 between the mating head 41 and the solder tail 48. Each mating head 41 is substantially a mirror image of the mating head 31 of the first contact 3 and comprises an elongate base portion 42, a pair of shoulder pieces 43 and opposite first and second retention pieces 45, 46. The shoulder pieces 43 and the retention pieces 45, 46 extend upwardly from the base portion 42 to abut against opposite sides of a corresponding lower passageway 29. The shoulder pieces 43 comprise a pair of mating arms 44 for mating with a second mating contact of the mating connector, and a pair of upwardly extending barbs 431 to be respectively retained in the lower retaining grooves 271. A pair of barbs 451, 461 respectively upwardly extend from the first and the second retention pieces 45, 46 and are respectively retained by the lower retaining grooves 271. A first barb 452 and a second barb 462 are respectively formed on the first and second retention pieces 45, 46 and are retained in corresponding first and second lower apertures 242, 243. The fixing portion 47 extends downwardly from the mating head 41 through a corresponding front cutout 247. The fixing portion 47 comprises a pair of ears 471 laterally extending from opposite sides thereof and respectively engaging in the front retaining channels 248 (best seen in FIG. 3). It is noted that similar to the (upper) first contact 3, the (lower) second contact 4 is inserted into the housing 2 from the rear wall 22 wherein the fixed portion 47 and the solder tail 48 initially extends horizontally coplanarly with base portion 42 during insertion of the second contact 4 into the housing 2, and successively bent to their final shapes after insertion. It is also noted that referring to FIG. 6, the front edges 331, 431 of the shoulder pieces 33, 43 confront and is hidden behind the steps 211 of the housing 2 so that the inserted pin of the complementary connector will not improperly influence those shoulder pieces 33, 43. It is also noted that each contact 3 (4) has two barbs 352, 362 (452, 462) arranged in a staggered manner in a transverse direction of the housing so that the barbs of all the contacts and the associated apertures of the housing are in a zigzag manner along the transverse direction.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for mounting on a printed circuit board (PCB), comprising:

an insulative housing defining a passageway, and comprising a retaining pole; and a contact comprising a mating head received in the passageway adapted for mating with a mating contact of a mating connector, a solder tail adapted for being soldered to the PCB, and a fixing portion between the mating head and the solder tail, the fixing portion comprising an aperture receiving the retaining pole of the housing;

wherein the retaining pole of the housing has a free end riveted on the fixing portion of the contact to securely retain the contact in the housing.

2. The electrical connector as claimed in claim 1, wherein the mating head of the contact forms a barb, and wherein the housing comprises a top wall defining an aperture, the barb engaging in the aperture.

3. The electrical connector as claimed in claim 1, wherein the housing comprises two partitioners, the passageway being defined between the partitioners, the retaining pole being formed between the partitioners.

4. The electrical connector as claimed in claim 3, wherein the housing comprises a bottom wall substantially perpendicular to the partitioners, and the retaining pole is formed on the bottom wall.

5. The electrical connector as claimed in claim 4, wherein the bottom wall defines a cutout retaining the fixing portion of the contact, and the retaining pole projects into the cutout.

6. The electrical connector as claimed in claim 5, wherein the bottom wall defines a retaining channel communicating with the cutout, and wherein the fixing portion of the contact forms an ear engaging with the retaining channel.

7. The electrical connector as claimed in claim 3, wherein the housing forms a spacer bar between the partitioners.

8. The electrical connector as claimed in claim 7, wherein the mating head of the contact forms a barb, and wherein the spacer bar defines a retaining groove engaging with the barb.

9. The electrical connector as claimed in claim 7, wherein the spacer bar defines a cutout retaining the fixing portion of the contact, and the retaining pole is formed on the spacer bar and projects into the cutout.

10. The electrical connector as claimed in claim 9, wherein the spacer bar defines a retaining channel communicating with the cutout, and wherein the fixing portion of the contact forms an ear engaging with the retaining channel.

11. An electrical connector mounted on a printed circuit board (PCB) and adapted for mating with a plurality of first and second mating contacts of a mating connector, comprising:

an insulative housing defining a plurality of upper passageways arranged in an upper row and a plurality of lower passageways arranged in a lower row;

a plurality of first contacts respectively inserted in the upper passageways in a first direction, each first contact comprising a mating head for mating with a corresponding first mating contact of the mating connector, a solder tail for being soldered to the PCB, and a fixing portion between the mating head and the solder tail; and a plurality of second contacts respectively inserted in the lower passageways in a second direction opposite to the first direction, each second contact comprising a mating head for mating with a corresponding second mating contact of the mating connector, a solder tail for being soldered to the PCB, and a fixing portion between the mating head and the solder tail;

wherein the solder tails of the first contacts and those of the second contacts oppositely project beyond the housing.

12. The electrical connector as claimed in claim 11, wherein the housing comprises opposite sidewalls and a plurality of partitioners parallel to the sidewalls, the sidewalls and partitioners together defining the upper passageways and the lower passageways therebetween.

13. The electrical connector as claimed in claim 12, wherein the housing forms a plurality of retaining poles between adjacent sidewalls and partitioners and exposed to outside of the housing, each retaining pole having a free end riveted on a corresponding first contact for securely retaining the corresponding first contact in the housing.

14. The electrical connector as claimed in claim 11, wherein the housing comprises a bottom wall forming a plurality of retaining poles, and wherein the fixing portion of each first contact defines an aperture engaging with a corresponding retaining pole.

15. The electrical connector as claimed in claim 14, wherein the bottom wall defines a plurality of cutouts retaining the fixing portions of the first contacts, and a plurality of retaining channels communicating with corresponding cutouts, wherein each first contact forms an ear engaging with a corresponding retaining channel.

16. The electrical connector as claimed in claim 11, wherein the housing forms a plurality of spacer bars for spacing the upper passageways and corresponding lower passageways.

17. The electrical connector as claimed in claim 16, wherein each spacer bar has a retaining pole, wherein the fixing portion of each first contact defines an aperture engaging with a corresponding retaining pole.

18. The electrical connector as claimed in claim 17, wherein each spacer bar defines a cutout retaining the fixing portion of each first contact and a retaining channel communicating with the cutout, and wherein the fixing portion of each first contact forms an ear engaging with a corresponding retaining channel.

19. An electrical connector comprising:

an insulative housing defining a plurality of upper and lower passageways extending therethrough between front and rear faces thereof;

a plurality of upper contacts forwardly inserted into the corresponding upper passageways from the rear face, respectively;

a plurality of lower contacts forwardly inserted into the corresponding lower passageways from the rear face, respectively;

each of said upper contacts including a vertical portion extending downwardly to a bottom face of the housing around the rear face with a solder tail at a bottom end thereof;

each of said lower contacts including a vertical portion extending downwardly to the bottom face of the housing around the front face with a solder tail at a bottom end thereof; wherein said vertical portion initially horizontally extends during forward insertion of the lower contact into the corresponding lower passageway, and is successively vertically bent to its final position;

wherein each of said lower contacts includes a front edge engaged with and hidden behind a step formed around the front face of the housing.

20. An electrical connector comprising:

an insulative housing defining a plurality of passageways extending therethrough in a front-to-back direction between front and rear faces of the housing;

a pair of apertures formed in the housing and in communication with each of said passageways and an exterior in a vertical direction perpendicular to said front-to-back direction; and a plurality of contacts disposed in the corresponding passageways, respectively, each of said contacts including a pair of barbs latchably received in the corresponding pair of apertures, respectively; wherein said pair of apertures are offset from each other in said front-to-back direction, and said pair of barbs are offset from each other in said front-to-back direction, and accordingly the all apertures are arranged in a staggered manner along a lengthwise direction of said housing which is perpendicular to both said front-to-back and said vertical direction.

* * * * *